US005937828A

United States Patent [19]

Watanabe

[11] Patent Number: 5,937,828

[45] Date of Patent: Aug. 17, 1999

[54] FUEL INJECTION INJECTOR CONTROLLER

[75] Inventor: Tetsushi Watanabe, Tokyo, Japan

[73] Assignee: Mitsubishi Denki Kabushiki Kaisha, Tokyo, Japan

[21] Appl. No.: 08/903,722

[22] Filed: Jul. 31, 1997

[51] Int. Cl.[6] ..... F02M 51/00; H01H 47/04

[52] U.S. Cl. ..... 123/490; 361/154

[58] Field of Search ..... 123/490; 361/154, 361/155

[56] References Cited

U.S. PATENT DOCUMENTS

| | | | |
|---|---|---|---|
| 4,338,651 | 7/1982 | Henrich | 123/490 |
| 4,479,161 | 10/1984 | Henrich et al. | 123/478 |
| 4,729,056 | 3/1988 | Edwards et al. | 361/154 |
| 4,753,207 | 6/1988 | Wright | 123/490 |
| 5,341,032 | 8/1994 | Brambilla et al. | 123/490 |
| 5,381,297 | 1/1995 | Weber | 361/154 |
| 5,430,601 | 7/1995 | Burcham | 123/490 |
| 5,469,825 | 11/1995 | Golab et al. | 123/481 |
| 5,711,280 | 1/1998 | Foerster et al. | 123/490 |
| 5,717,562 | 2/1998 | Antone et al. | 361/155 |

FOREIGN PATENT DOCUMENTS

| | | | |
|---|---|---|---|
| 19650437 | 6/1997 | Germany . | |
| 1-318740 | 12/1989 | Japan | F02D 41/20 |
| WO-9002872 | 3/1990 | WIPO . | |

*Primary Examiner*—Erick R. Solis
*Attorney, Agent, or Firm*—Sughrue, Mion, Zinn, Macpeak & Seas, PLLC

[57] ABSTRACT

A fuel injection injector controller comprises high voltage generation means for stepping up voltage based on electric power from a power supply to generate a voltage higher than the power supply, first switching means being disposed on a power supply passage from the high voltage generation means to an injector for conducting when a valve of the injector is opened upon reception of a drive signal, negative voltage generation means for generating a negative-polarity voltage, and second switching means being disposed on a power supply passage from the negative voltage generation means to the injector for conducting when the valve of the injector is closed upon reception of the drive signal.

2 Claims, 3 Drawing Sheets

OFF
ON
t1
t2 t3 t4

IK
IH
-IG

FUEL INJECTION INJECTOR CONTROLLER

BACKGROUND OF THE INVENTION

This invention relates to a fuel injection injector controller for controlling a fuel injector for fueling an internal combustion engine.

Hitherto, a solenoid valve injector has been adopted as a fuel injection device into an internal combustion engine. A controller of the injector obtains information concerning the running state of an engine and calculates a fuel injection amount for setting the air fuel ratio of the internal combustion engine to a desired air fuel ratio based on the information according to the injector drive time. An electric current is supplied to the injector during the drive time. When the injector is energized, it opens its valve for injecting fuel and when the injector is de-energized, it closes its valve for stopping the fuel supply.

In such an injector, it is desirable to open the valve as soon as the injector is energized and close the valve as soon as the injector is de-energized in order to accurately match the calculated drive time and fuel injection amount. To enhance responsivity of the injector, a system is proposed, for example, as shown in Unexamined Japanese Patent Publication 1-318740.

In the system disclosed here, when energization of an injector is started, an excessive current called overexcitation current is supplied, thereby hastening the valve opening operation of the injector. After the valve is opened, the energization current is lowered to a holding current required for holding the valve of the injector open and the holding current is held for suppressing heat generation of the injector and decreasing a power loss. This is called overexcitation energization control.

Although the system supplies an overexcitation current when energization of the injector is started, the overexcitation current depends on battery voltage and if the battery voltage is low, the overexcitation current value also lessens and it is difficult to sufficiently hasten the valve opening operation.

When the valve of the injector is closed, the conventional injector controller relies only on high-speed shutdown for an LCR resonance circuit to consume energy accumulated in an excitation circuit of the injector; it is difficult to sufficiently hasten the valve opening operation.

Thus, to control an injector for such high-speed response application controlling a high fuel pressure, such as an injector for cylinder injection of fuel into a gasoline engine or a fuel injection injector into a diesel engine, the controller is not sufficient in the aspect of control responsivity or control resolution and it is difficult to sufficiently widen the injector control range.

To hold the valve open state in the injector, the conventional injector controller feeds back the energization current value of the injector, generates a triangular wave rising when the current value is smaller than a target value and falling when the current value is larger than the target value, and supplies the triangular wave as a holding current. However, the triangular wave depends on the battery voltage. More particularly, although the speed when the current value is lowered depends on factors other than the battery voltage, the speed when the current value is raised also depends on the battery voltage.

That is, if the battery voltage is low, sufficient power is not supplied and if an attempt is made to raise the current value, it takes time as compared with the case where the battery voltage is sufficiently high. Thus, if the battery voltage is low, the time until the triangular wave rises from the bottom to the top is prolonged. Resultantly, the ripple period of the triangular wave is prolonged.

Here, assume that the target value is the holding current value of the injector. If the ripple period is short, the injector cannot follow the triangular wave, thus the injector holds the valve open state. If the ripple period is prolonged, the injector follows the triangular wave and there is a possibility that the valve will be closed when the value is less than the holding current.

Thus, the target value needs to be set to a current value higher than the holding current value to set more than the holding current value even at the bottom of the triangular wave; power consumption is large.

SUMMARY OF THE INVENTION

It is therefore an object of the invention to provide a fuel injection injector controller with good control responsivity that can drive an injector promptly regardless of the battery voltage.

It is another object of the invention to decrease the value of a holding current supplied to an injector for reducing power consumption in a fuel injection injector controller with good control responsivity.

It is another object of the invention to decrease power consumption in the holding current generation section for suppressing heat generation and miniaturizing a controller.

It is another object of the invention to stop needless operation for decreasing power consumption and suppressing occurrence of noise in a fuel injection injector controller with good control responsivity.

According to the invention, there is provided a fuel injection injector controller comprising means for detecting information concerning a running state of an internal combustion engine, means for calculating an amount of fuel supplied to the internal combustion engine based on the detection result of the detection means, means for generating a drive signal for opening or closing a valve of an injector for supplying fuel to the internal combustion engine upon reception of the calculation result of the fuel amount calculation means, a power supply, high voltage generation means for stepping up voltage based on electric power from the power supply to generate a voltage higher than the power supply, first switching means being disposed on a power supply passage from the high voltage generation means to the injector for conducting when the valve of the injector is opened upon reception of the drive signal, negative voltage generation means for generating a negative-polarity voltage, and second switching means being disposed on a power supply passage from the negative voltage generation means to the injector for conducting when the valve of the injector is closed upon reception of the drive signal.

Further, the fuel injection injector controller according to the invention includes means for generating a predetermined constant voltage based on electric power of the power supply and holding current generation means for receiving the constant voltage from the constant voltage generation means and the drive signal from the drive signal generation means and supplying a holding current for holding the valve of the injector open after the valve of the injector is opened.

The fuel injection injector controller according to the invention may use low voltage generation means for generating a voltage lower than the power supply as the constant voltage generation means.

Moreover, according to the invention, there is provided a fuel injection injector controller comprising means for detecting information concerning a running state of an internal combustion engine, means for calculating an amount of fuel supplied to the internal combustion engine based on the detection result of the detection means, means for generating a drive signal for opening or closing a valve of an injector for supplying fuel to the internal combustion engine upon reception of the calculation result of the fuel amount calculation means, a power supply, high voltage generation means for stepping up voltage based on electric power from the power supply to generate a voltage higher than the power supply, first switching means being disposed on a power supply passage from the high voltage generation means to the injector for conducting when the valve of the injector is opened upon reception of the drive signal, and means, upon reception of the drive signal from the drive signal generation means, for inhibiting the step-up operation of the high voltage generation means for a predetermined time since the valve open time of the injector.

According to the invention, there is provided a fuel injection injector controller with good control responsivity that can drive an injector promptly regardless of the battery voltage.

Further, a constant voltage is input and a holding current is generated, so that the value of the holding current supplied to the injector can be decreased for reducing power consumption.

Furthermore, low voltage generation means for generating a constant voltage lower than the battery voltage is adopted, thus power consumption in the holding current generation section can be decreased for suppressing heat generation and miniaturizing the controller.

Furthermore, needless operation in the overexcitation period can be stopped for decreasing power consumption and suppressing occurrence of noise.

DETAILED DESCRIPTION OF THE PREFERRED EMBODIMENTS

Referring now to the accompanying drawings, there are shown preferred embodiments of the invention.

First Embodiment

Figure 1:
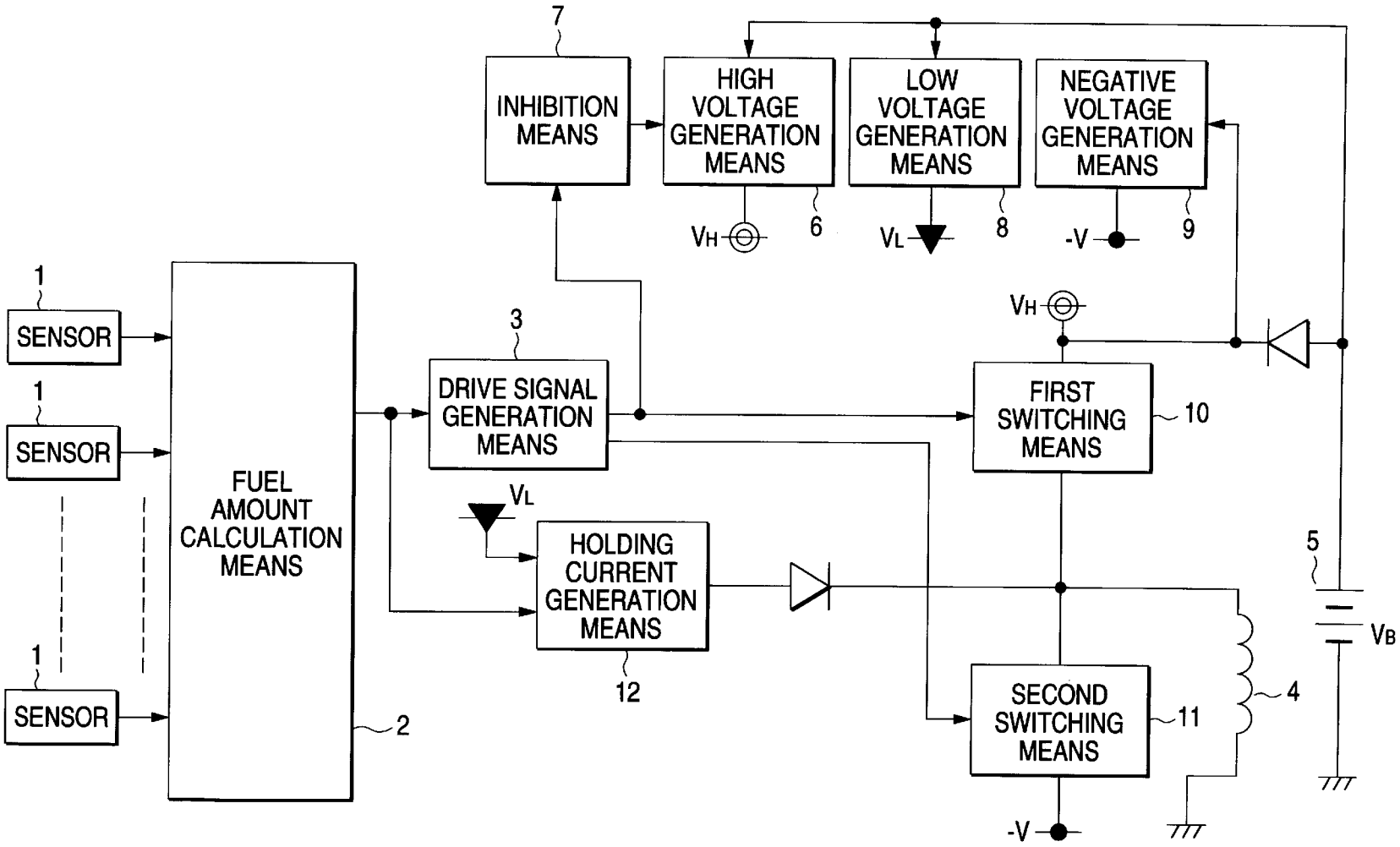
FIG. 1 is a block diagram to show the configuration of a first embodiment of the invention.

FIG. 1 is a block diagram to show the configuration of a first embodiment of the invention.

In the figure, numeral 1 is sensors as detection means for detecting information concerning the running state of an internal combustion engine. The sensors 1 get various pieces of information such as air suction amount, inlet pipe pressure, crank angle, the number of revolutions, air fuel ratio, cooling water temperature, and atmospheric pressure. Numeral 2 is fuel amount calculation means for calculating the amount of fuel supplied to the internal combustion engine based on the information from the sensors 1, numeral 3 is drive signal generation means for receiving the calculation result of the fuel amount calculation means and generating a drive signal for opening or closing a valve of an injector 4, numeral 5 is a battery of a power supply, numeral 6 is high voltage generation means for stepping up battery voltage VB and generating higher voltage VH than the battery voltage VB, numeral 7 is inhibition means for inhibiting the step-up operation of the high voltage generation means 6, numeral 8 is low voltage generation means as constant voltage generation means for stepping down the battery voltage VB and generating constant low voltage VL lower than the battery voltage VB, numeral 9 is negative voltage generation means for receiving the battery voltage VB or the high voltage VH and generating negative-polarity voltage −V, numeral 10 is first switching means being disposed on a power supply passage from the high voltage generation means 6 to the injector 4 for receiving a drive signal from the drive signal generation means 3 and conducting when the valve of the injector 4 is opened, numeral 11 is second switching means being disposed on a power supply passage from the negative voltage generation means 9 to the injector 4 for receiving a drive signal from the drive signal generation means 3 and conducting when the valve of the injector 4 is closed, and numeral 12 is holding current generation means for receiving the low voltage VL and the calculation result of the fuel amount calculation means 2 and supplying a holding current for holding the valve of the injector 4 open after the valve of the injector 4 is opened.

Figure 2:
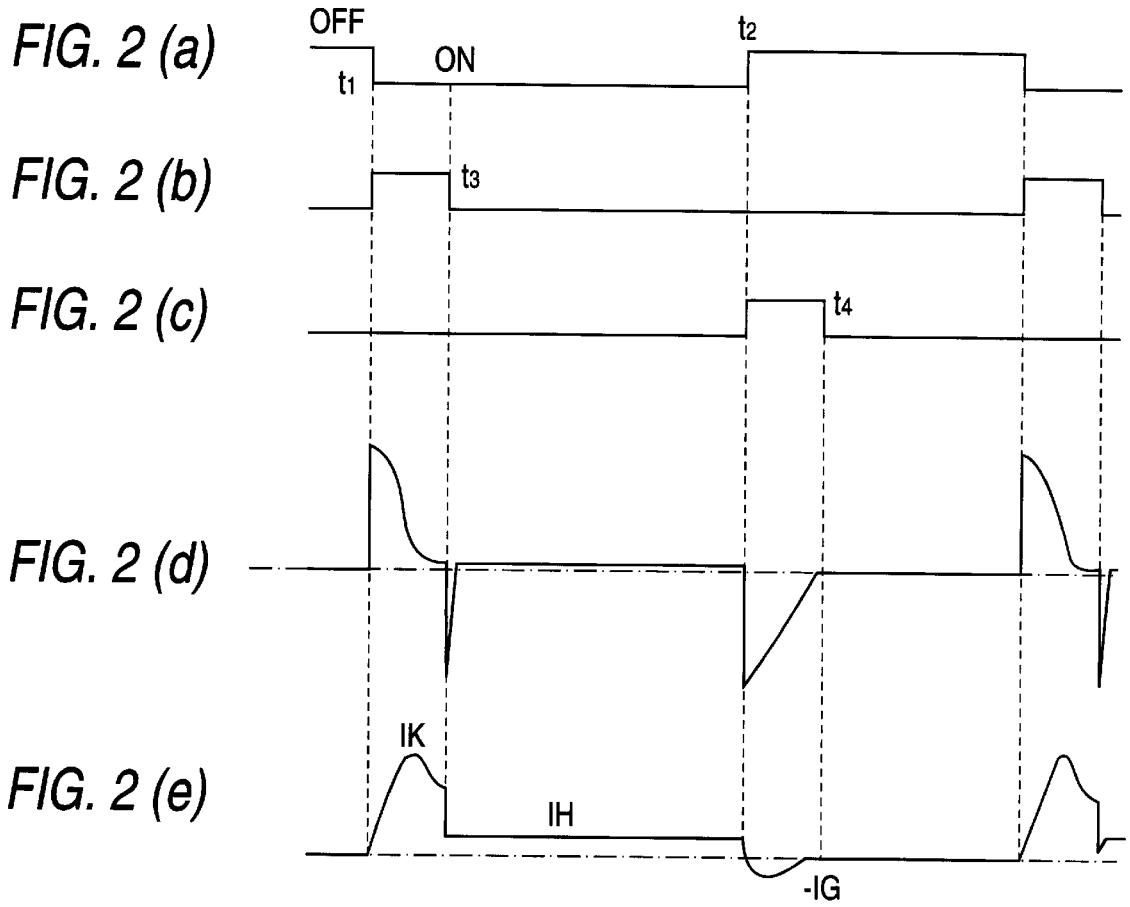
FIGS. 2(*a–e*) are a time chart to show the operation of the first embodiment of the invention.

FIG. 2 is a time chart to show the operation of the first embodiment.

In the figure, (a) indicates an output signal of the fuel amount calculation means 2, (b) indicates a drive signal output from an upper output terminal of the drive signal generation means 3 shown in the figure, (c) indicates a drive signal output from a lower output terminal of the drive signal generation means 3 shown in the figure, (d) indicates a voltage of an upper output terminal of the injector 4 shown in the figure, and (e) indicates a current supplied to the injector 4.

First, the operation when the valve of the injector is opened will be discussed.

The fuel amount calculation means 2 calculates the fuel amount based on information provided by the sensors 1 and outputs the calculation result as in (a). In the figure, an instruction is given so that the injector enters the valve open state in the period between time t1 and time t2. If the period is short, fuel is injected in a small fuel amount; if the period is long, fuel is injected in a large fuel amount. The drive signal generation means 3 receives the calculation result and supplies a drive signal as in (b) to the first switching means 10. The signal in (b) goes and remains high in the period between time t1 and time t3. While the signal is high, an overexcitation current is supplied to the injector. The first switching means 10 receives the drive signal (b). When the drive signal (b) is high, the first switching means 10 conducts and supplies high voltage VH to the injector 4. At this time, high voltage is applied to the upper output terminal of the injector shown in the figure as in (d), whereby the current of the injector 4 rises abruptly as shown in (e), enabling the valve of the injector 4 to be opened in a short time.

Thus, the control responsivity when the valve of the injector 4 is opened can be improved.

By the way, a general step-up circuit chops energization current of a choke coil and accumulates only the positive-polarity voltage provided by chopping the current in a capacitor.

Therefore, if charge accumulated in the capacitor is abruptly consumed because of supply to the injector 4, the overexcitation state of the injector 4 cannot be held in the period between time t1 and time t3.

To solve this problem, in the first embodiment, the battery voltage VB is supplied via a diode to output of the high voltage generation means 6.

Therefore, if the high voltage VH becomes lower than the battery voltage VB, the battery 5 instead of the high voltage generation means 6 supplies an electric current to the injector 4 for holding the overexcitation state.

Thus, the overexcitation current is supplied stably during the overexcitation period from the two power sources.

The controller of the first embodiment further includes the inhibition means 7 for inhibiting the step-up operation of the high voltage generation means 6.

The drive signal (b) is given to not only the first switching means, but also the inhibition means 7 as shown in the figure. The inhibition means 7 receives the drive signal (b) and inhibits the step-up operation of the high voltage generation means 6 in the period between time t1 and time t3 as a predetermined time.

Thus, high-speed large invalid current flowing into the high voltage generation means 6 from the battery 5 is stopped during the overexcitation period.

Resultantly, wasteful power consumed internally by the high voltage generation means 6 can be decreased and noise caused by inflow of the high-speed and large current can be suppressed.

Next, the operation in the period between time 3 and time 2 for holding the valve of the injector 4 open will be discussed.

When time 3 is reached, the drive signal generation means 3 causes the drive signal (b) to make the high to low transition. The first switching means 10 receives the signal and switches from the conduction state to the nonconduction state. Thus, the current supply from the high voltage VH or the battery voltage VB is shut off and the energization current of the injector 4 is decreased at a stroke.

On the other hand, the holding current generation means 12 receives the low voltage VL and the calculation result of the fuel amount calculation means 2 (a) and generates a holding current and supplies the current to the injector 4 based on the constant low voltage VL lower than the battery voltage VB during the period between time t1 and time t2 in which the calculation result (b) is low. The current is supplied from the holding current generation means 12 via a diode as shown in FIG. 1.

Therefore, the current supplied through the first switching means 10 does not flow into the holding current generation means 12 and output of the holding current from the holding current generation means 12 is inhibited during the period between time t1 and time t3. If time t3 is reached and the first switching means 10 enters the nonconduction state, the holding current from the holding current generation means 12 is supplied promptly to the injector 4.

The holding current generation means 12 generates the holding current based on a constant voltage. Therefore, it is not necessary to set the target value of the output current higher than the injector holding current considering the effect of fluctuation of the battery voltage VB as in the conventional system.

Thus, the target value of the current output from the holding current generation means 12 can be lessened as compared with the conventional system and power consumption can be decreased.

The holding current generation means 12 generates the holding current based on the voltage VL lower than the battery voltage VB.

Therefore, the power loss caused by the internal circuitry is decreased and heat generation is suppressed, thereby miniaturizing the controller.

The holding current generation means 12 generates the holding current during the period between time t1 and time t2, but may use the drive signals (b) and (c) to generate the holding current only in the period in which the holding current is required between time 3 and time 2.

Next, the operation when the valve of the injector 4 is closed will be discussed.

When time t2 is reached, the calculation result of the fuel amount calculation means 2 (a) makes the low to high transition and the holding current generation means 12 stops output of the holding current. Thus, current supply to the injector 4 is stopped and the injector 4 attempts to close the valve gradually while discharging accumulated power.

On the other hand, the drive signal generation means 3 receives the calculation result (a) and supplies the drive signal (c) to the second switching means 11. When receiving the drive signal (c), the second switching means 11 conducts and supplies negative voltage −V to the injector 4.

Thus, the power accumulated in the injector 4 flows into the negative voltage −V at a stroke, causing the injector 4 to be forcibly demagnetized and close the valve promptly.

Resultantly, the control responsivity when the valve of the injector 4 is closed is improved.

Next, the first embodiment will be discussed with reference to a detailed circuit diagram.

Figure 3:
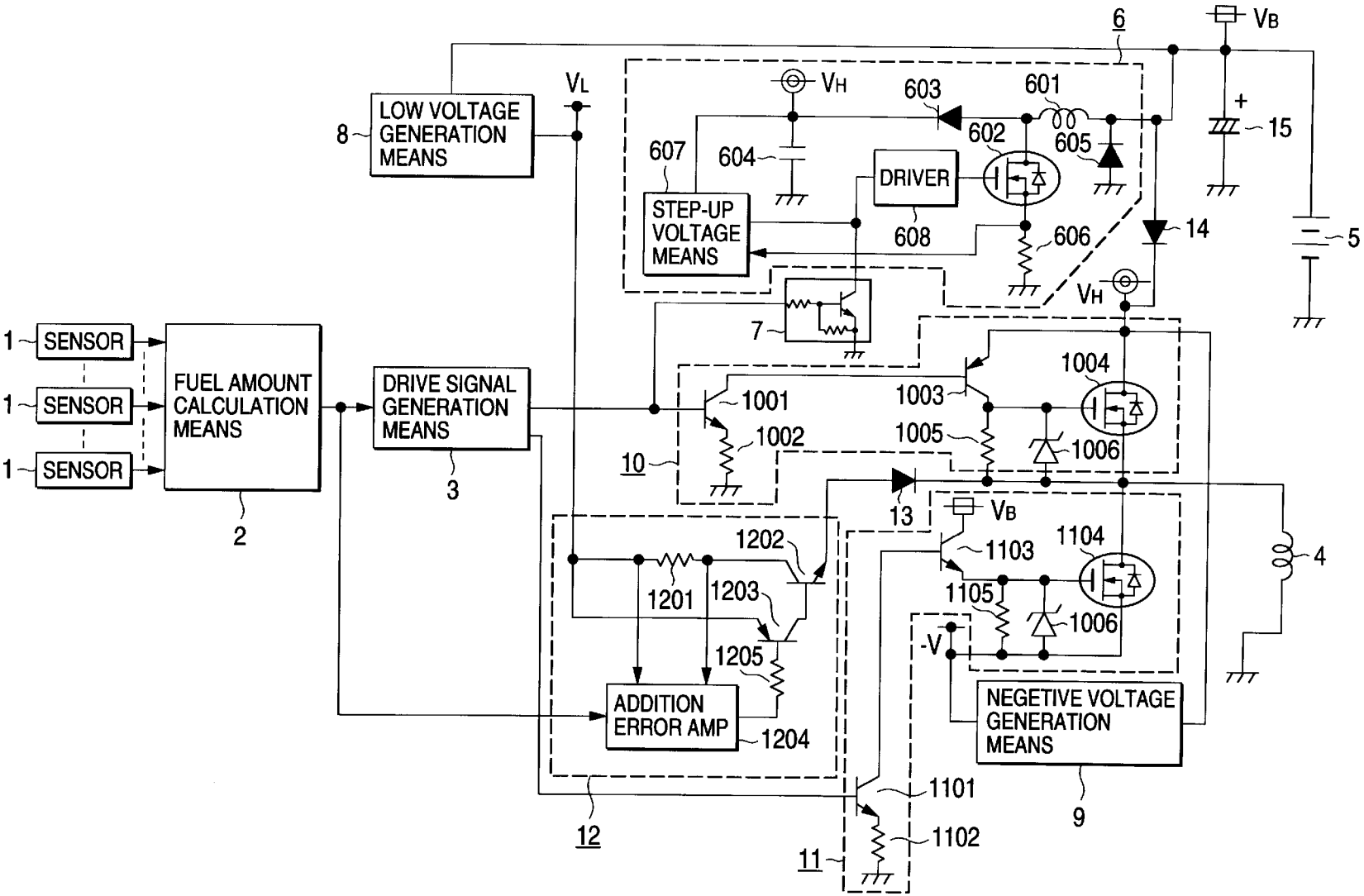
FIG. 3 is a circuit diagram to show the configuration of the first embodiment of the invention.

FIG. 3 is a circuit diagram to show the configuration of the first embodiment. Circuit parts identical with or similar to those previously described with reference to FIG. 1 are denoted by the same reference numerals in FIG. 3.

Numeral 1 is sensors, numeral 2 is a control section as the fuel amount calculation means, numeral 3 is a timing signal generation circuit of the drive signal generation means for receiving a fuel supply amount signal as the calculation result from the control section 2 and generating a timing signal as a drive signal for distributing timing, numeral 4 is the injector, and numeral 5 is the battery.

Numeral 6 is a high voltage generation circuit forming a DC/DC converter as the high voltage generation means. The high voltage generation circuit 6 is made up of the following:

Numeral 601 is a choke coil for generating an induced electromotive voltage, numeral 602 is a chopper FET transistor for turning on or off energization current of the choke coil 601 for controlling switching, numeral 603 a rectifier diode for allowing transmission of only positive-polarity voltages of voltages generated at the choke coil, numeral 604 is a capacitor for accumulating the positive-polarity voltage transmitting the rectifier diode 603, numeral 605 is a commutation diode for providing a current passage of the choke coil 601, numeral 606 is a shunt resistor for measuring the value of current flowing into the FET transistor 602, numeral 607 is a step-up voltage control circuit for receiving accumulated voltage of the capacitor 604 and output voltage of the shunt resistor 606, performing constant voltage control of the accumulated voltage of the capacitor 604 to predetermined high voltage VH, and detecting a shutdown current value of the choke coil 601 for control, and numeral 608 is a driver circuit for receiving a signal from the step-up voltage control circuit 607 and driving the FET transistor 602.

Numeral 7 is a step-up function stopping transistor as inhibition means being connected to an upper output terminal of the timing signal generation circuit 3 shown in the figure for receiving a timing signal from the output terminal and inhibiting the step-up operation of the high voltage generation circuit 6. The transistor 7 grounds a signal supplied from the step-up voltage control circuit 607 to the driver circuit 608 for forcibly stopping the switching operation of the FET transistor 602. Numeral 8 is a low voltage generation circuit as low voltage generation means for receiving the battery voltage VB and stepping down the voltage VB to generate a constant voltage lower than the battery voltage VB. The low voltage generation circuit 8 forms a constant voltage generation circuit at the same time. Numeral 9 is a negative voltage generation circuit as negative voltage generation means for inverting voltage of the high voltage generation circuit 6.

Numeral 10 is the first switching means, which is made up of the following:

Numeral 1001 is a transistor connected at a base to the timing signal generation circuit 3 and driven by a timing signal from the upper output terminal of the timing signal generation circuit 3 shown in the figure. The transistor 1001 is connected at an emitter to ground via an emitter resistor 1002 and at a collector to a base of a transistor 1003. The transistor 1003 is a transistor driven by the transistor 1001 and is connected at an emitter to the high voltage VH and at a collector to a gate of an FET transistor 1004. Numeral 1005 is a gate-to-source resistor of the FET transistor 1004 and numeral 1006 is a gate-to-source protection diode of the FET transistor 1004. The FET transistor 1004 is connected at a drain to the high voltage VH and at a source to the injector 4 for supplying or shutting off the high voltage VH to the injector 4 in response to the switching operation of the transistor 1003.

Numeral 11 is the second switching means, which is made up of the following:

Numeral 1101 is a transistor connected at a base to the timing signal generation circuit 3 and driven by a timing signal from the lower output terminal of the timing signal generation circuit 3 shown in the figure. The transistor 1101 is connected at an emitter to ground via an emitter resistor 1102 and at a collector to a base of a transistor 1103. The transistor 1103 is a transistor driven by the transistor 1101 and is connected at an emitter to the battery voltage VB and at a collector to a gate of an FET transistor 1104. Numeral 1105 is a gate-to-source resistor of the FET transistor 1104 and numeral 1106 is a gate-to-source protection diode of the FET transistor 1104. The FET transistor 1104 is connected at a drain to the injector 4 and at a source to the negative voltage −V for supplying or shutting off the negative voltage −V to the injector 4 in response to the switching operation of the transistor 1103.

Numeral 12 is the holding current generation means, which is made up of the following:

Numeral 1201 is a shunt resistor for converting the value of a holding current supplied to the injector 4 into a voltage value for detection. The shunt resistor 1201 is connected at one end to the low voltage VL and at the other end to a collector of a transistor 1202. Numeral 1203 is a transistor for driving the transistor 1202. The transistor 1203 is connected at an emitter to the low voltage VL and at a collector to a base of the transistor 1202. Numeral 1204 is an addition error amplification circuit for receiving the calculation result of the control section 2 and voltage across the shunt resistor 1201 and giving a signal to a base of the transistor 1203 via a resistor 1205 for driving the transistor 1203. While the signal from the control section 2 is on, the addition error amplification circuit 1204 performs constant current control so that the voltage across the shunt resistor 1201 becomes a value corresponding to a predetermined holding current value.

A constant current generated here is supplied to the injector 4 via a counter current check diode 13.

Numeral 14 is a bypass diode for supplying the battery voltage VB to the injector 4 when the voltage VH of the high voltage generation circuit 6 lowers during the overexcitation period. The bypass diode 14 is connected at an anode to the battery voltage VB and at a cathode to the high voltage VH. Numeral 15 is a power stabilization capacitor for stabilizing the battery voltage VB.

The operation of the circuitry in FIG. 3 will be discussed with reference to the time chart in FIG. 2.

The control section 2 calculates the amount of fuel injected from the injector 4 based on the information such as the air suction amount, the number of revolutions, and water temperature provided by the sensors 1 and supplies the calculation result shown in (a) in FIG. 2 to the timing signal generation circuit 3. Upon reception of the calculation result, the timing signal generation circuit 3 outputs the timing signal shown in (b) in FIG. 2 from the upper output terminal shown in the figure and the timing signal shown in (c) from the lower output terminal shown in the figure.

First, the operation when the valve of the injector 4 is opened will be discussed.

The high voltage generation circuit 6, which forms a step-up DC/DC converter, steps up the battery voltage VB to the high voltage VH.

Power from the battery 5 is fed into the choke coil 601. Energization current flowing into the choke coil 601 is allowed to flow or is shut down by the FET transistor 602, whereby inductive voltage of high voltage is generated in the choke coil 601. The positive-polarity voltage of the generated inductive voltage passes through the rectifier diode 603 and is accumulated in the capacitor 604. The voltage of the capacitor 604 is input to the step-up voltage control circuit 607, which then performs constant voltage control so that the voltage of the capacitor 604, namely, the high voltage VH becomes a predetermined voltage. The constant voltage control is carried out by adjusting the driver signal given to the driver circuit 608 for driving the FET transistor 602 from the step-up voltage control circuit 607.

On the other hand, the timing signal generation circuit 3 gives the signal corresponding to the overexcitation period shown in FIG. 2 (b) to the bases of the transistors 1001 and 7 from the upper output terminal shown in the figure.

The timing signal (b) goes high at time t1 and a current flows from the base of the transistor 1001 via the emitter, causing the transistor 1001 to conduct. When the transistor 1001 conducts, a current flows on a passage from the high voltage VH to the emitter and base of the transistor 1003 to the collector and emitter of the transistor 1001 to ground, thereby causing the transistor 1003 to conduct. When the transistor 1003 conducts, a current flows on a passage from the high voltage VH to the emitter and collector of the transistor 1003 to the gate-to-source resistor 1005 to the injector 4 to ground, and a potential difference occurs between the gate and source of the FET transistor 1004, causing the FET transistor 1004 to conduct.

Then, the high voltage VH and the injector 4 are connected and a current flows on a passage from the high voltage VH to the drain and source of the FET transistor to the injector 4 to ground. The current rises very steeply as shown in (e) in FIG. 2; it rises to the maximum value IK at a stroke. Thus, the time until the valve opening current value of the injector 4 is reached is shortened and the current causes the valve of the injector 4 to be opened promptly.

By the way, the current into the injector 4 decreases after it reaches the maximum value IK, because the charge accumulated in the capacitor 604 of the high voltage generation circuit 6 is discharged at a stroke. Here, assuming that a long overexcitation period is set because of the characteristic of the injector, the capacitor 604 continues to be discharged and finally the valve opening current value of the injector 4 may become unable to be supplied. Thus, the bypass diode 14 is adopted in the first embodiment. If the value of the high voltage VH lowers with discharging of the capacitor 604 and falls below the battery voltage VB, the bypass diode 14 causes the battery voltage VB instead of the high voltage VH to supply a current to the injector 4.

The timing signal (b) is also supplied to the base of the transistor 7. The transistor 7 inhibits the step-up operation of the high voltage generation circuit 6 during the overexcitation period in response to the timing signal (b).

When the timing signal (b) which is high is supplied, a current flows on a passage from the base and emitter of the transistor 7 to ground, causing the transistor 7 to conduct. The transistor 7 is connected at the collector to a driver signal supply passage from the step-up voltage control circuit 607 to the driver circuit 608 and is connected at the emitter to ground. Thus, when the transistor 7 conducts, the driver signal output from the step-up voltage control circuit 607 is grounded and deactivated and the driver circuit 608 stops driving the FET transistor 602.

Thus, high-speed, large-current invalid power flowing into the high voltage generation circuit 6 from the battery 5 can be stopped during the overexcitation period.

Also, power consumption in the high voltage generation circuit 6 can be decreased and noise caused by high-speed, large-current power with a large noise component can be reduced.

Next, holding the valve open state of the injector 4 will be discussed.

The low voltage generation circuit 8 is provided by a switching regulator step-down circuit using a transformer or a choke coil and a capacitor or a linear dropper system with the battery voltage VB as input voltage.

The low voltage generation circuit 8 inputs the battery voltage VB, generates predetermined constant voltage VL lower than the battery voltage VB, and supplies the voltage to the shunt resistor 1201 and the collector of the transistor 1203. While the calculation result (a) of the control section 2 is a low signal, the addition error amplification circuit 1204 monitors the voltage across the shunt resistor 1201 and drives and controls the transistors 1203 and 1202 so that the voltage across the shunt resistor becomes a voltage value corresponding to the holding current value.

The holding current is supplied to the injector 4 via the counter current check diode 13. Therefore, the counter current check diode 13 inhibits supply of the holding current during period between time t1 and t3 and after time t3, the FET transistor 1004 enters the nonconduction state, then the holding current indicated by current IH in (e) in FIG. 2 is supplied to the injector 4.

Here, the holding current generation circuit 8 uses as a power supply, output of a constant voltage circuit for generating a constant voltage if the battery voltage VB fluctuates. Thus, to set the holding current IH, fluctuation of the battery voltage VB need not be considered.

Therefore, the holding current IH can be set to the minimum holding current value for holding the valve of the injector 4 open for decreasing power consumption.

A low voltage circuit for generating the voltage VL lower than the battery voltage VB as a constant voltage is adopted particularly in the embodiment.

Therefore, when control is performed so that constant current IH flows into the shunt resistor 1201, a loss caused by the switching operation of the transistor 1202 can be decreased and heat generation can be suppressed. Thus, small-power transistors can be adopted as the transistors 1202 and 1203 and the controller can be miniaturized.

Next, the operation when the valve of the injector 4 is closed will be discussed.

First, at time t2, the control section 2 causes the calculation result signal (a) to make the low to high transition. The addition error amplification circuit 1204 receives the signal and changes the target current value from the holding current IH to 0 A (amperes), thereby causing the transistors 1203 and 1202 to enter the nonconduction state, stopping current supply to the injector 4.

When the current supply is stopped, the injector 4 makes the transition from the valve open state to the valve closed state. This valve closing operation is performed gradually while the remaining magnetic flux accumulated in the injector 4 is being consumed.

On the other hand, at time t2, the timing signal generation circuit 3 outputs the timing signal (c) from the lower output terminal shown in the figure. The timing signal (c) goes high in the period between time t2 and time t4 and acts as an inverse excitation signal.

The high signal causes a current to flow on a passage from the base and emitter of the transistor 1101 to the resistor 1102 to ground, making the transistor 1101 to conduct. When the transistor 1101 conducts, a current flows on a passage from the battery voltage VB to the emitter and base of the transistor 1103 to the collector and emitter of the transistor 1101 to the resistor 1102 to ground, causing the transistor 1103 to conduct. When the transistor 1103 conducts, a current flows on a passage from the battery voltage VB to the emitter and collector of the transistor 1103 to the gate-to-source resistor 1105 to the negative voltage −V.

The negative voltage −V is generated by the negative voltage generation circuit 9. The negative voltage generation circuit 9 is made of a pump circuit using a capacitor with the high voltage VH or the battery voltage VB as an input voltage.

When a current flows into the gate-to-source resistor 1105, a voltage drop occurs across the resistor and the potential difference occurring between the gate and source of the FET transistor 1104 causes the FET transistor 1104 to conduct.

The FET transistor 1104 is connected at the drain to the injector 4 and at the source to the negative voltage −V.

Therefore, the negative voltage −V is connected when an attempt is made to close the valve gradually while the remaining magnetic flux accumulated in the injector 4 is being consumed at time t2. Thus, a current flows on a passage from the injector 4 to the drain and source of the FET transistor 1104 to the negative voltage −V and the remaining magnetic flux accumulated in the injector 4 is consumed at a stroke.

Thus, the remaining magnetic flux hindering the valve closing operation of the injector 4 is consumed in a short time, whereby the valve closing operation of the injector 4 is performed in a short time.

The inverse excitation using the negative voltage −V is executed during the inverse excitation period between time t2 and time t4.

The high voltage VH or the battery voltage VB is used as the input voltage of the negative voltage generation circuit, but the low voltage VL may be used.

Therefore, the valve of the injector can be opened and closed at high speed regardless of the battery voltage, whereby the control range of the injector can be widened.

What is claimed is:

1. A fuel injection injector controller comprising:

means for detecting information concerning a running state of an internal combustion engine;

means for calculating an amount of fuel supplied to the internal combustion engine based on the detection result of said detection means;

means for generating a drive signal for opening or closing a valve of an injector for supplying fuel to the internal combustion engine upon reception of the calculation result of said fuel amount calculation means;

a power supply supplying a power supply voltage;

high voltage generation means for stepping up said power supply to generate a voltage higher than said power supply voltage;

first switching means disposed on a power supply passage from said high voltage generation means to the injector for conducting when the valve of the injector is opened upon reception of the drive signal;

negative voltage generation means for generating a negative-polarity; and second switching means disposed on a power supply passage from said negative voltage generation means to the injector for conducting when the valve of the injector is closed upon reception of the drive signal, wherein said high voltage generation means includes a choke coil for receiving electric power from said power supply, an FET transistor for allowing current to flow into said choke coil, and a step-up voltage control circuit for performing constant voltage control so that the stepped up voltage is at a predetermined value.

2. A fuel injection injector controller comprising:

means for detecting information concerning a running state of an internal combustion engine;

means for calculating an amount of fuel supplied to the internal combustion engine based on the detection result of said detection means;

means for generating a drive signal for opening or closing a valve of an injector for supplying fuel to the internal combustion engine upon reception of the calculation result of said fuel amount calculation means;

a power supply supplying a power supply voltage;

high voltage generation means for stepping up said power supply to generate a voltage higher than said power supply voltage;

first switching means disposed on a power supply passage from said high voltage generation means to the injector for conducting when the valve of the injector is opened upon reception of the drive signal;

negative voltage generation means for generating a negative-polarity voltage; and second switching means disposed on a power supply passage from said negative voltage generation means to the injector for conducting when the valve of the injector is closed upon reception of the drive signal, p1 wherein a bypass diode is provided which is connected between a first switch device and the high voltage generating means, which sends a current from the power supply to the first switch device, when the higher voltage falls below the battery voltage.

* * * * *